United States Patent [19]

Berg

[11] Patent Number: 4,917,036

[45] Date of Patent: Apr. 17, 1990

[54] LIFT GENERATING SAIL SYSTEM FOR MULTIHULL SAILCRAFT

[76] Inventor: Randy J. Berg, 6813 W. 83rd St., Bloomington, Minn. 55438

[21] Appl. No.: 386,444

[22] Filed: Jul. 28, 1989

[51] Int. Cl.[4] ..... B63B 15/00

[52] U.S. Cl. ..... 114/91; 114/39.1

[58] Field of Search ..... 114/90, 91, 102, 39.1

[56] References Cited

U.S. PATENT DOCUMENTS

| | | | |
|---|---|---|---|
| 3,972,300 | 8/1976 | Adamski | 114/91 |
| 4,005,669 | 2/1977 | Klemm | 114/91 |
| 4,706,590 | 11/1987 | Hoyt | 114/91 |

*Primary Examiner*—Sherman D. Basinger
*Assistant Examiner*—Jesus Sotelo

[57] ABSTRACT

A device for allowing the base of the mast of a multihull sailcraft to be positioned leeward of the top of the mast. It comprises a mast, shroud lines, an arced track whose radius centers at the shroud line attachment to the mast, apparatus for regulating the travel of the base of the mast along the arced track, apparatus for reducing travel friction between the base of the mast and the arced track, and apparatus for allowing the arced track to be rotated around its central vertical axis and locked in position.

3 Claims, 7 Drawing Sheets

LIFT GENERATING SAIL SYSTEM FOR MULTIHULL SAILCRAFT

BACKGROUND OF INVENTION

1. FIELD OF INVENTION

This invention relates to a device for enabling a sail rigging system to position a sail in a position which generates lift force in addition to conventional thrust vectors.

2. STATE OF PRIOR ART

Current sailboats use a mast which has its base fixated to a single point on the sailboat. Current sailboats also often use shroud lines to attach a higher point of the mast to the boat for additional stabilization of the mast.

Sailboards have a mast which articulates to the hull through a universal joint, Permitting the mast to be held at various angles to the hull.

In general, it can be said that multihull sailcraft are faster than monohull sailcraft. Recent sailboard designs, however, have attained higher top speeds than multihull sailcraft.

When sailing in higher winds, a sailboard mast may be tipped windward, thereby generating a substantial lift force. Conventional multihull sailcraft have a mast which is, at best, vertical. In high winds, their mast is tipped toward the downwind side of the boat, generating substantial downforce.

Hull draft and drag can be greatly reduced by utilizing lift force from the sail. This invention harnesses this opportunity.

SUMMARY OF THE INVENTION

The invention relates to a device which allows the top of the mast of a multihull sailcraft to be tipped windward of the base of the mast. It comprises a mast, shroud lines, an arced track whose radius centers at the shroud line attachment to the mast, a means for regulating the travel of the base of the mast along the track, and a means for reducing travel friction between the base of the mast and the arced track.

DESCRIPTION OF THE PREFERRED EMBODIMENT

Figure 1:
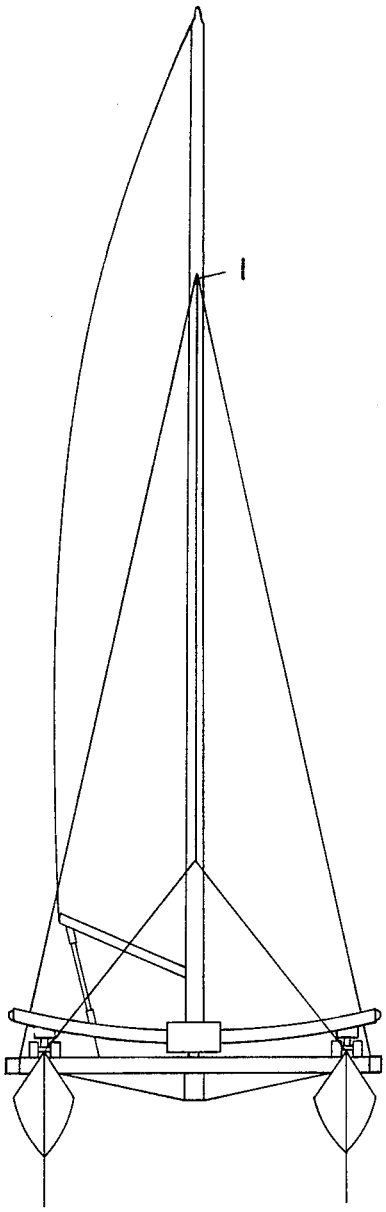
FIG. 1 is an anterior view of a multihull sailcraft equipped with a lift generating sail system.

FIG. 1 is a drawing of an anterior view of a multihull sailcraft equipped with a lift generating sail system. The shroud line attachment point 1 is the primary attachment of the mast to the boat and is the only fixed point of the mast. Shroud line attachment point 1 is higher than the majority of sail area.

Figure 2:
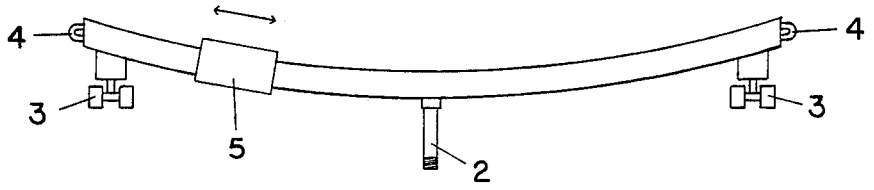
FIG. 2 is an anterior view of the arced track and glider assembly.

FIG. 2 is a drawing of an anterior view of the glider assembly and arced track. The arc of the track centers at the shroud line attachment point 1. The arced track has a central support member 2 and two end support rollers 3 and adjustment line attachments 4. The slider assembly 5 is circumferential to the arced track except for a gap to allow transit freely past the central support member of the arced track 2.

Figure 3:
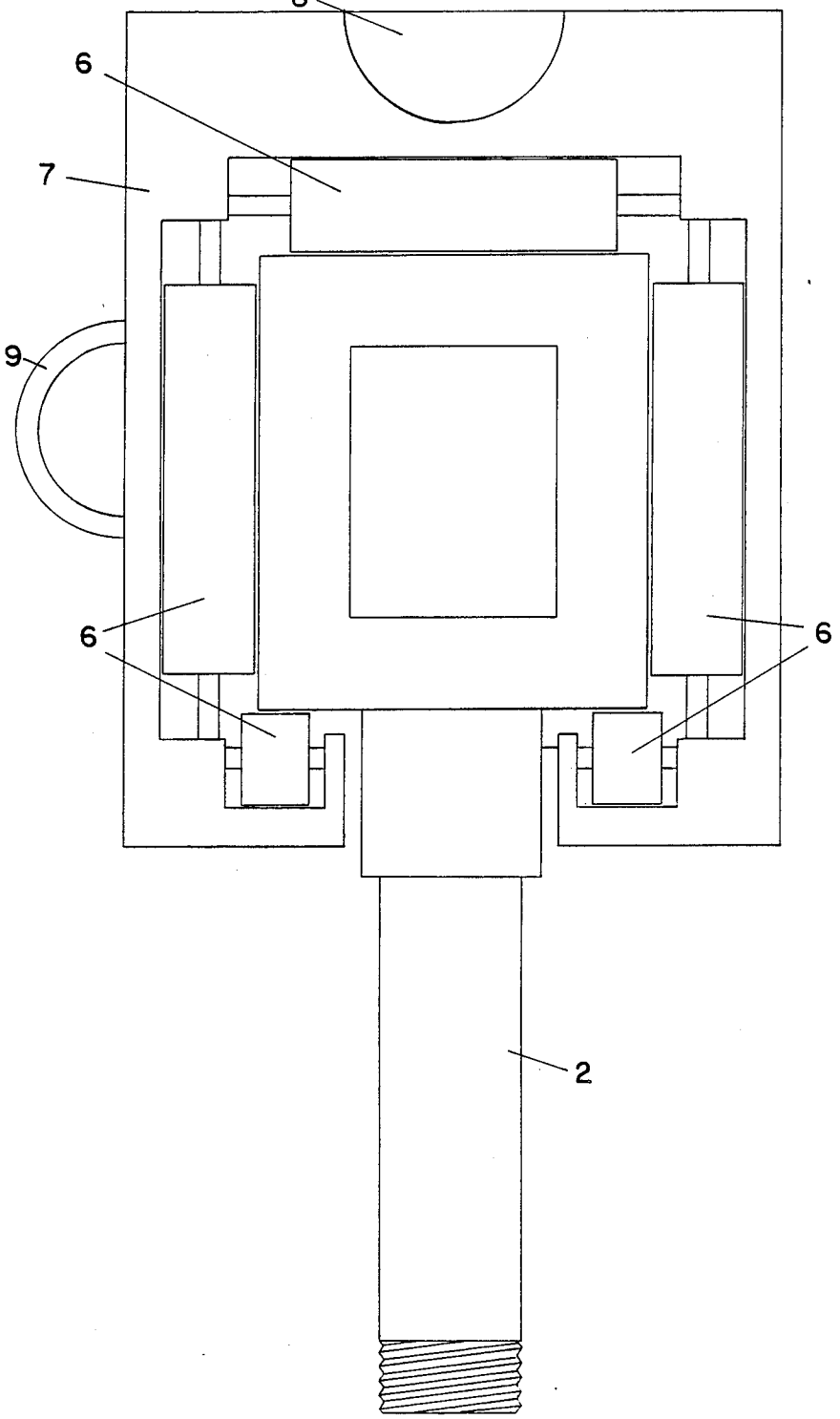
FIG. 3 is a cross-sectional view of the arced track and glider assembly.

FIG. 3 is a drawing of a cross sectional view of the arced track and glider assembly showing: glider rollers 6, glider body 7, joint for articulating with the mast 8, central support member of the arced track 2, and attachments for the travel limiting line 9. A retaining nut would thread onto the central support member.

Figure 4:
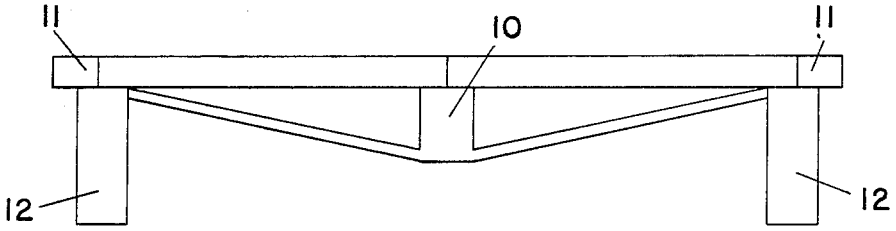
FIG. 4 is an anterior view of the support frame for the arced track.

FIG. 4 is a drawing of an anterior view of the support frame for the arced track. The support frame has a central mounting hub 10 which articulates with the central support member of the arced track 2. The support frame has two end support platforms 11 which articulate with the end support rollers of the arced track 3. The support frame attaches to the hulls via a number of hull mount posts 12.

Figure 5:
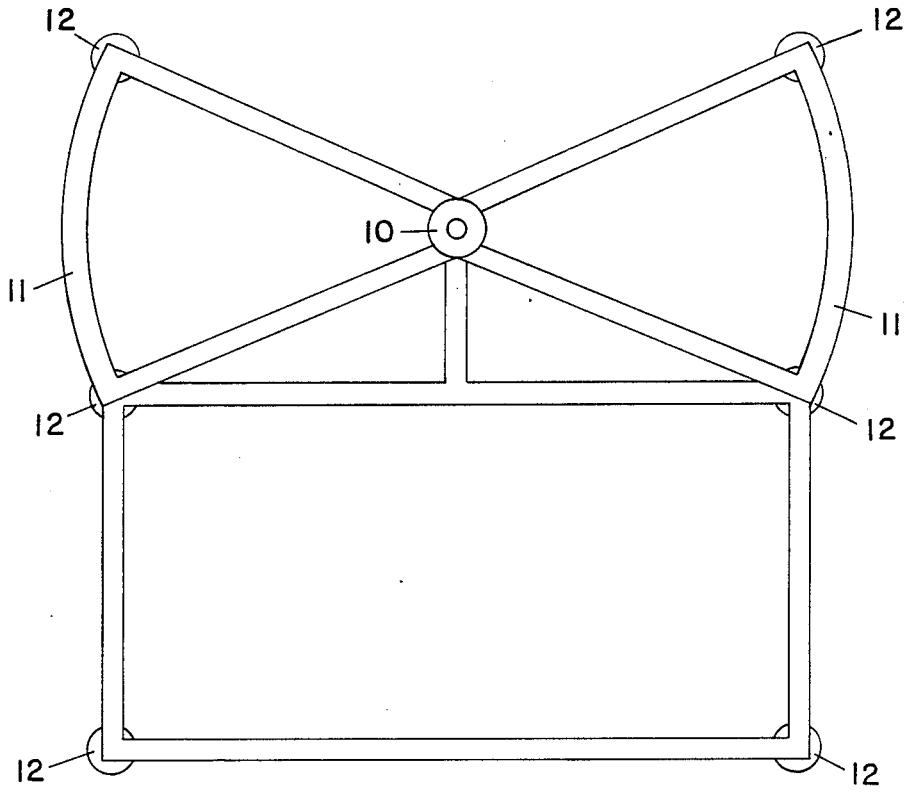
FIG. 5 is a top view of the support frame for the arced track.

FIG. 5 is a drawing of a top view of the support frame showing: the central mounting hub 10, end support platforms 11, and hull mount posts 12.

Figure 6:
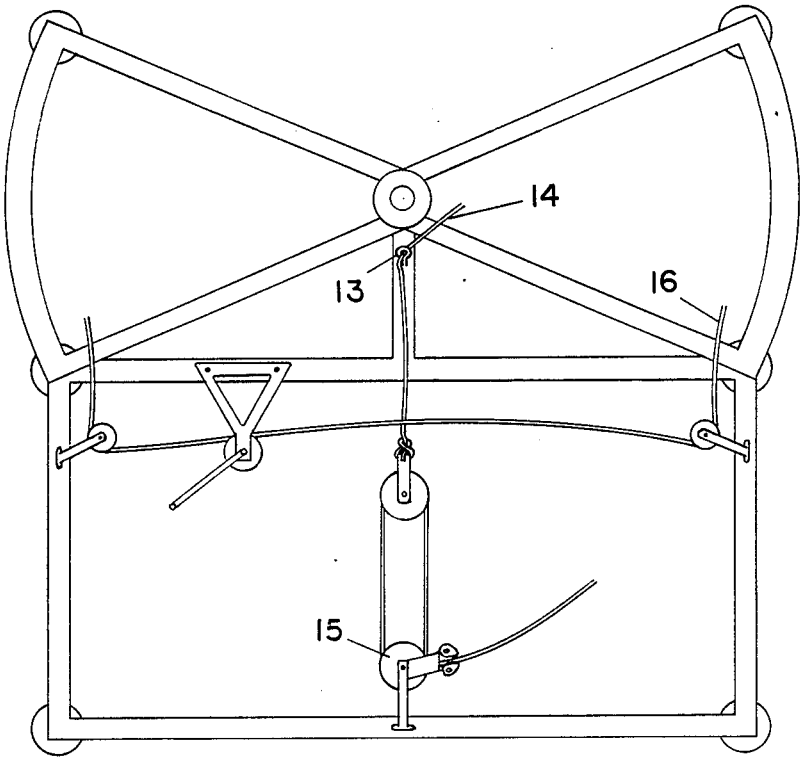
FIG. 6 is a top view of the trampoline cockpit area.

FIG. 6 is a drawing of a top view of the trampoline cockpit area showing the central mounting ring 13 through which the travel limiting line 14 passes. FIG. 6 also shows a cleatable block assembly 15 which adjusts and fixes the length of the travel limiting line 14, determining the travel of the base of the mast from the midline of the boat. A cleatable adjustment line 16 for determining and locking the rotational position of the arced track is also controlled from the trampoline cockpit area.

Figure 7:
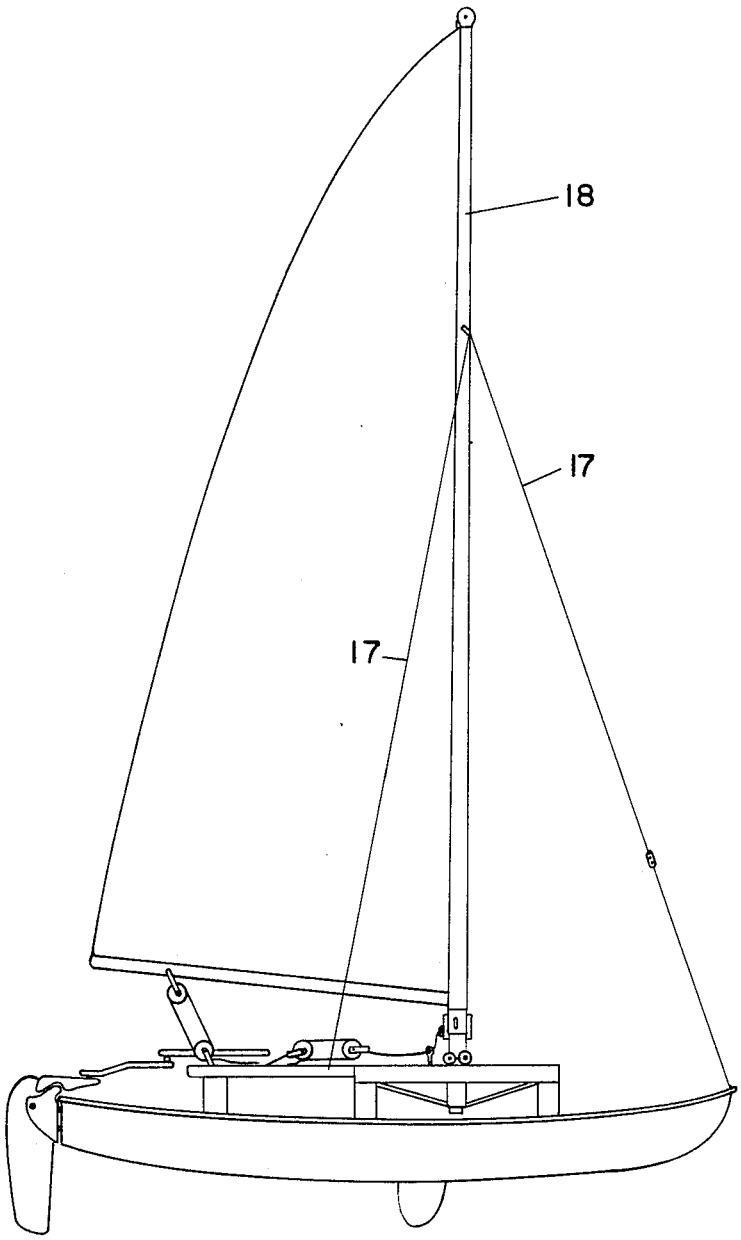
FIG. 7 is a side view of a multihull sailcraft equipped with a lift generating sail system.

FIG. 7 is a drawing of a side view of a multihull sailboat equipped with a lift generating sail system showing the shroud lines 17.

FUNCTIONAL OVERVIEW

The lift generating sail system is essentially a complex pendulum. The pivot point is the shroud attachment to the mast. The mast is tensioned against the pivot point by the shroud lines and the arced track-glider assembly. The base of the mast is free to travel side to side along the arced track while maintaining a constant pressure upon the pivot point.

The arced track is additionally mounted upon a central hub which allows it to rotate about a vertical axis. The rotation of the arced track allows proper sail positioning throughout a greater range of boat directional headings.

I claim:

1. A lift generating sail system for multihull sailcraft which comprises:

(a) a mast;

(b) a number of shroud lines;

(c) an arced track;

(d) a means of attaching the base of the mast to and guiding the travel of the base of the mast along the arced track;

(e) a means of limiting the friction due to travel of the base of the mast along the arced track;

(f) an adjustable means of determining the distance that the base of the mast can travel along the arced track away from the midline of the boat;

(g) a means of rotating the arced track around its central vertical axis;

(h) a means of locking the rotational position of the arced track.

2. A lift generating sail system for multihull sailcraft as recited in claim 1, in which:

(a) the shroud lines attach to a single point on the mast which is the only fixed point of the mast;

(b) the fixed point of the mast is higher than the majority of sail area.

3. A lift generating sail system for multihull sailcraft as recited in claim 2, in which:

(a) the radial center of the arced track is the shroud line attachment point to the mast.

* * * * *